United States Patent [19]

Crownover

[11] 4,006,733

[45] Feb. 8, 1977

[54] FREE STANDING FIREPLACE FOR MOBILE HOMES

[75] Inventor: Glen D. Crownover, Santa Rosa, Calif.

[73] Assignee: Malm Fireplaces, Inc., Santa Rosa, Calif.

[22] Filed: July 14, 1975

[21] Appl. No.: 595,447

[52] U.S. Cl. ..... 126/143; 126/202; D23/97

[51] Int. Cl.[2] ..... F24B 13/02

[58] Field of Search ..... 126/120, 121, 123, 143, 126/202, 62, 65; D23/95, 96, 97

[56] References Cited

UNITED STATES PATENTS

| | | | |
|---|---|---|---|
| 2,470,430 | 5/1949 | Cartner | 126/143 |
| 3,094,980 | 6/1963 | Inabnit | 126/121 |
| 3,096,754 | 7/1963 | Howrey | 126/120 |
| 3,339,540 | 9/1967 | Kreider | 126/121 |
| 3,499,432 | 3/1970 | Hannebaum | 126/120 |
| 3,809,058 | 5/1974 | Becker | 126/120 |
| 3,888,231 | 6/1975 | Galluzzo et al. | 126/120 |
| 3,910,251 | 10/1975 | Andrew | 126/120 |

FOREIGN PATENTS OR APPLICATIONS

| | | | |
|---|---|---|---|
| 838,251 | 6/1960 | United Kingdom | 126/143 |

*Primary Examiner*—John J. Camby
*Assistant Examiner*—Larry I. Schwartz
*Attorney, Agent, or Firm*—Flehr, Hohbach, Test, Albritton & Herbert

[57] ABSTRACT

A free standing fireplace for a mobile home vents incoming air into the fireplace through a vertical vent extending through the floor of the mobile home into a conical base and vents the combustion products through a chimney which extends through the ceiling. The combustion air reaches the firebox area through a conical flow space provided between the fire bowl and conical base.

4 Claims, 3 Drawing Figures

FREE STANDING FIREPLACE FOR MOBILE HOMES

BACKGROUND OF THE INVENTION

The present invention is directed to a free standing fireplace for a mobile home and more particularly a fireplace which conforms to safety requirements therefor.

To obtain approval for a mobile home fireplace in many states such fireplace must have outside air induced into the firebox to supply oxygen to the fire; in addition, no dampers whatsoever are allowed. A typical type of fireplace utilizes a double or triple liner exhaust stack to draw in combustion air through such stack. This is, for example, illustrated by U.S. Pat. No. 3,094,980 to Inabnit. Two other examples of fireplaces which draw air from outside of the room are Carter U.S. Pat. No. 2,470,430 and Howard U.S. Pat. No. 260,199. Both of these constructions are either not suitable for mobile home use or are relatively costly.

OBJECTS AND SUMMARY OF THE INVENTION

It is, therefore, an object of the present invention to provide an improved fireplace for use in mobile homes.

It is another object of the invention to provide a fireplace as above which is free standing and which is economical in construction.

In accordance with the above objects there is provided a free standing fireplace for a mobile home having a floor and ceiling. A base for resting on the floor forms a cavity and has a central vertical axis. Elongated vent means have an axis substantially coincident with the central axis forming the lower boundary of the cavity for extending through the floor to the outside atmosphere. Concave fire bowl means for retaining fuel is suspended in and forms the upper boundary of the cavity. Hood means are juxtaposed above the base and fire bowl means. A chimney is connected to the hood and has an axis coincident with the central axis for extending through the ceiling to the outside atmosphere.

DETAILED DESCRIPTION OF THE PREFERRED EMBODIMENT

Figure 1:
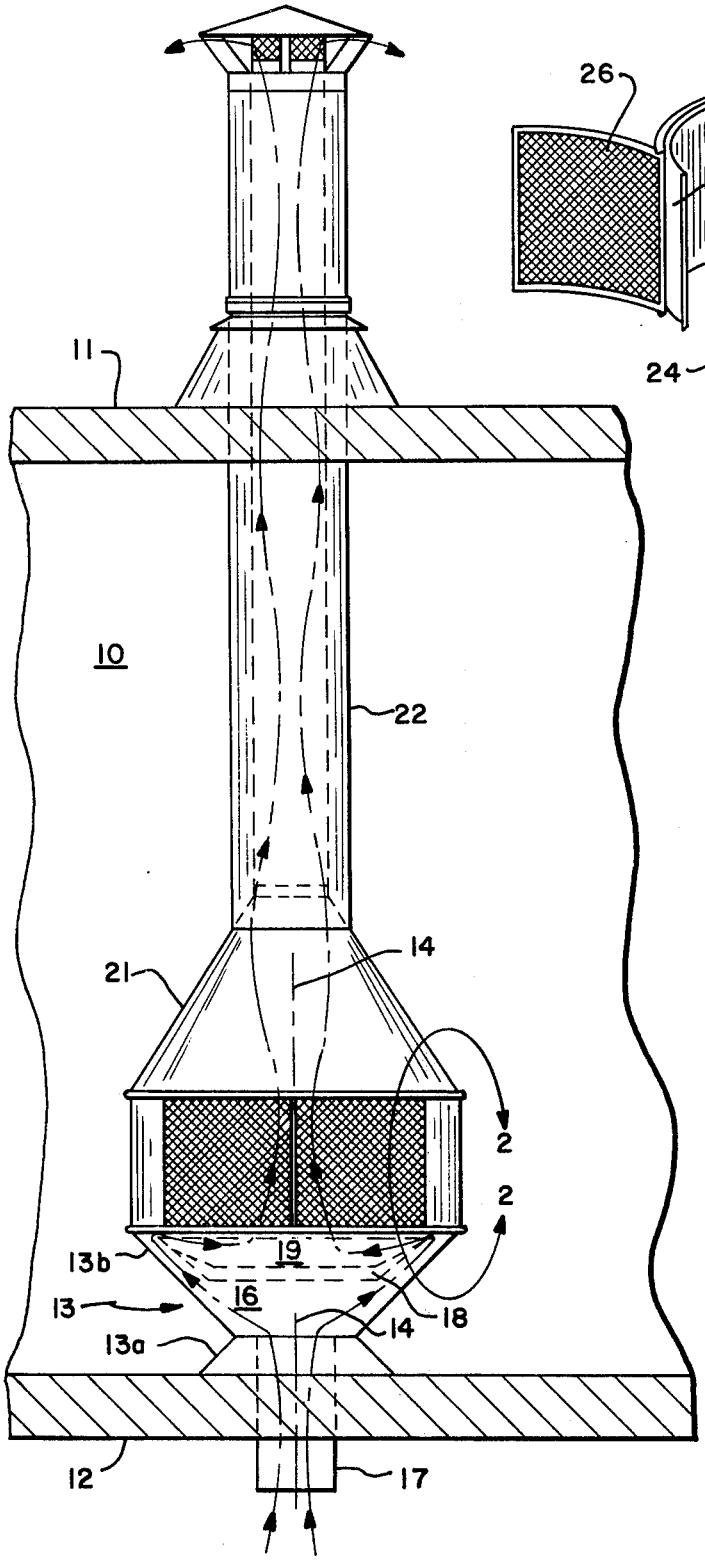
FIG. 1 is an elevation view of a free standing fireplace as it would be installed in a mobile home which is shown in cross section.

FIG. 1 illustrates a mobile home 10 having a ceiling 11 and a floor 12. The free standing fireplace of the present invention includes a sheet metal base 13 having a lower conical portion 13*a* and an inverted upper conical portion 13*b*. The base has a central axis at 14. Base 13 forms a cavity 16 bounded at its lower end by a cylindrical vent 17 which extends vertically through the floor 12 and has an axis coincident with axis 14 and bounded on its upper end by a fire bowl 18. The fire bowl includes a spun base which is filled with suitable refractory to provide a fire area at 19 for holding fuel.

Figure 3:
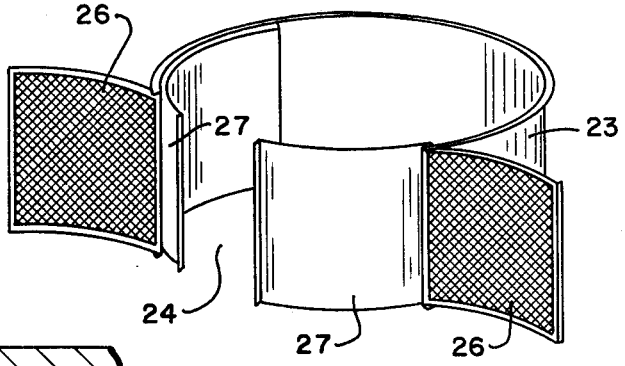
FIG. 3 is a perspective view of the door portion of FIG. 1.

A conical hood 21 is substantially above the base 13 and fire bowl 18 and is connected to a chimney 22 which extends through ceiling 11. The cylindrical chimney 22 also has an axis coincident with axis 14. Base 13 and hood 21 are joined by a cylindrical intermediate portion 23 as best shown in FIG. 3 which has an opening 24 which may be either closed by a pair of meshed doors 26 or sliding steel doors 27. Steel doors as illustrated in FIG. 2 ride in the track provided buy the upper and lower I-beams 28 and 29.

Figure 2:
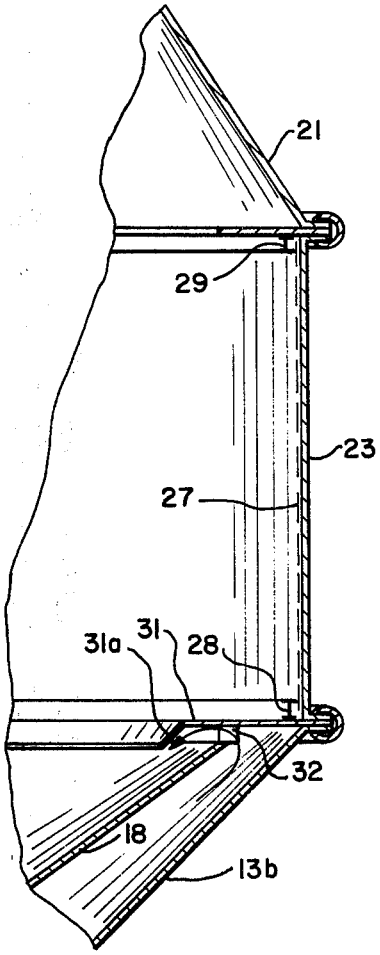
FIG. 2 is an enlarged detailed cross sectional view taken along line 2—2 of FIG. 1.

Fire bowl 18 is suspended in the cavity 16 formed by base 13 so that its conical sidewalls are spaced a predetermined distance from the upper conical portion 13*b* as, for example, best shown in FIG. 2, to form a flow space from the lower vent 17 to the fuel in the fire area 19. Fire bowl 18 itself is suspended from an air deflector ring 31 as shown in FIG. 2 by spacers 32 (only one of which is shown). Spacers 32 provide in essence a substantially continuous circular opening of approximately one inch to allow air to flow into the firebox area 19. This flow of air is further directed toward full in fire area 19 by a down turned portion 31*a* of the air deflector ring 31.

The free standing fireplace as thus described allows outside ambient air through vent 17 to supply oxygen to the fire box area 19 and thereafter the combustion products are easily vented through the chimney 22 again into the outside atmosphere. There are no dampers either in the incoming vent 17 or the chimney 22. The steel doors 27 when closed seal the entire fireplace from the interior of the mobile home.

What is claimed is:

1. A free standing fireplace for a mobile home having a floor and ceiling comprising: a base for resting on said floor forming a cavity and having a central vertical axis; elongated vent means having an axis substantially coincident with said central axis forming the lower boundary of said cavity for extending through said floor to the outside atmosphere; concave fire bowl means for retaining fuel suspended in and forming the upper boundary of said cavity said fire bowl means being spaced from the wall of said cavity for forming a flow space from said vent means to said fuel; hood means juxtaposed above said base and fire bowl means; and a chimney connected to said hood and having an axis coincident with said central axis for extending through said ceiling to the outside atmosphere.

2. A fireplace as in claim 1 where said cavity is cone shaped and said fire bowl means includes a conical side wall spaced from the wall of said cavity to form a conical flow space from said vent means to said fuel.

3. A fireplace as in claim 2 where said base includes an annular air deflector ring and said fire bowl means includes means for spacing its upper rim a predetermined distance from said air deflector ring to direct air from said conical flow space toward said fuel in said fire bowl means.

4. A fireplace as in claim 1 together with an intermediate cylindrical portion joining said base to said hood means including a pair of sliding solid doors for sealing the fireplace from the interior of said mobile home.

* * * * *